US006149390A

United States Patent [19]

Fisher et al.

[11] Patent Number: 6,149,390

[45] Date of Patent: Nov. 21, 2000

[54] SUMP PUMP SYSTEM AND APPARATUS

[75] Inventors: L. Edwin Fisher; James A. Butcher; James V. Yu; Mark A. Reiter, all of Fort Wayne, Ind.; Greg Skene, Roswell, Ga.

[73] Assignee: General Electric Company, Schnectady, N.Y.

[21] Appl. No.: 09/383,294

[22] Filed: Aug. 25, 1999

Related U.S. Application Data

[60] Provisional application No. 60/141,405, Jun. 29, 1999.

[51] Int. Cl.[7] ..... F04B 49/04

[52] U.S. Cl. ..... 417/40; 417/63; 417/423.3; 417/424.1

[58] Field of Search ..... 417/40, 63, 41, 417/424.1, 423.3

[56] References Cited

U.S. PATENT DOCUMENTS

| | | | |
|---|---|---|---|
| 3,255,702 | 6/1966 | Gehrm | 417/40 |
| 3,814,544 | 6/1974 | Roberts et al. | 417/40 |
| 3,932,853 | 1/1976 | Cannon | 340/244 B |
| 3,972,647 | 8/1976 | Niedermeyer | 417/2 |
| 3,999,890 | 12/1976 | Niedermeyer | 417/17 |
| 4,084,073 | 4/1978 | Keener | 200/84 R |
| 4,262,216 | 4/1981 | Johnston | 307/118 |
| 4,456,432 | 6/1984 | Mannino | 417/2 |
| 4,482,299 | 11/1984 | Eulass | 417/54 |
| 4,575,597 | 3/1986 | Akhter | 200/84 R |
| 4,852,609 | 8/1989 | Schoenauer | 137/565 |
| 5,015,152 | 5/1991 | Greene | 417/40 |
| 5,076,762 | 12/1991 | Lykes et al. | 417/40 |
| 5,181,841 | 1/1993 | Kirkland | 417/423.3 |
| 5,343,890 | 9/1994 | Deutch | 137/363 |
| 5,696,493 | 12/1997 | Einck | 340/623 |
| 5,975,866 | 11/1999 | Fisher et al. | 417/423.3 |

*Primary Examiner*—Charles G. Freay
*Assistant Examiner*—Robert Z. Evora
*Attorney, Agent, or Firm*—Carl B. Horton, Esq.; Damian Wasserbauer, Esq.; Armstrong Teasdale LLP

[57] ABSTRACT

A submersible sump pump connected to a discharge pipe is disclosed. The sump pump includes a pedestal mounted above a sump. The pedestal includes a power cord, an indicator, and a high water alarm. The sump pump further includes a float switch connected to a styrofoam float which detects movement of the drainage level beyond a first predetermined point, a second predetermined point, and a third predetermined point.

39 Claims, 5 Drawing Sheets

SUMP PUMP SYSTEM AND APPARATUS

CROSS REFERENCE TO RELATED APPLICATION

This application claims the benefit of U.S. Provisional Application Ser. No. 60/141,405, filed Jun. 29, 1999.

BACKGROUND OF THE INVENTION

This invention relates generally to pumps and, more particularly, to sump pumps.

Buildings are typically constructed with basements or locations in which drainage may accumulate. Drainage may seep into a building structure and damage the structure or contents if the drainage is not properly removed. Most buildings include drainage systems which direct the drainage into a well or a sump formed in the basement floor of the structure. The drainage is collected in the sump for eventual discharge through an existing drainage system.

However, drainage may accumulate in the sump at a faster rate than an existing discharge rate of the sump. When the sump accumulation rate is faster than the sump discharge rate, drainage overflows into a surrounding area of the structure. Typically, drainage pumps may be utilized in the sump to assist in the discharge of accumulated drainage. These drainage pumps are commonly referred to as sump pumps and may be either a submersible sump pump or a pedestal sump pump depending upon the location of a motor with respect to the accumulated drainage. The motor in the submersible sump pump is positioned within the drainage whereas the motor in the pedestal sump pump is positioned on a pedestal above the pump and the drainage.

The submersible sump pump is typically less costly to manufacture than a comparably rated pedestal sump pump due, at least in part to the motor of the submersible sump pump being smaller than the motor of the pedestal sump pump. In addition, the submersible sump pump motor may be cooled by the drainage in which it operates. Sump pumps typically include a float connected to a float switch, and a power cord.

Submersible sump pumps may fail due to improper draining of the sump. Typically, a pressurized float is connected by a float rod to a lever connected to the float switch which activates the sump pump motor. Any problems, such as breakage or locking, with the pressurized float, the float rod, or the lever will lead to failure of the sump pump. In addition, submersible sump pumps may experience motor failure due to exposure of a power cord to the accumulated drainage and short circuiting of the power cord caused by the accumulated drainage.

Accordingly, it would be desirable to protect the sump pump from damage caused by accumulated drainage without adding complexity to the sump pump. In addition, it would be desirable to reduce the fabrication costs of the sump pump.

BRIEF SUMMARY OF THE INVENTION

In an exemplary embodiment of the invention, a submersible sump pump includes a styrofoam float connected to a float switch to energize the submersible sump pump.

More particularly, a power cord is connected to and energizes the float switch and the submersible sump pump which includes a submersible motor and an attached pump. A pseudo pedestal is mounted above the submersible motor and the attached pump, and includes a plurality of openings in which an indicator, the power cord, a high drainage alarm, and the float switch are mounted. The float switch includes a lever connected to the styrofoam float by a float rod which moves between an OFF position, an ON position, and a high drainage position.

The indicator, power cord, high drainage alarm, and float switch are maintained above any accumulated drainage in a sump by the pseudo pedestal. A protective sheath connects and protects the wiring extending from the indicator, power cord, high drainage alarm, and float switch mounted in the pseudo pedestal to the submersible motor and the attached pump from exposure to drainage.

The indicator includes a first light emitting device (LED) and a second LED which activate to alert an observer to the operation of the submersible motor and the float switch, respectively. The high drainage alarm includes an audible indicator and LED which alert the observer when the submersible sump pump fails to discharge the accumulated drainage.

The submersible sump pump provides protection from damage caused by accumulated drainage. In addition, the submersible sump pump is less costly to fabricate than a comparably rated pedestal sump pump.

DETAILED DESCRIPTION OF THE INVENTION

Figure 1:
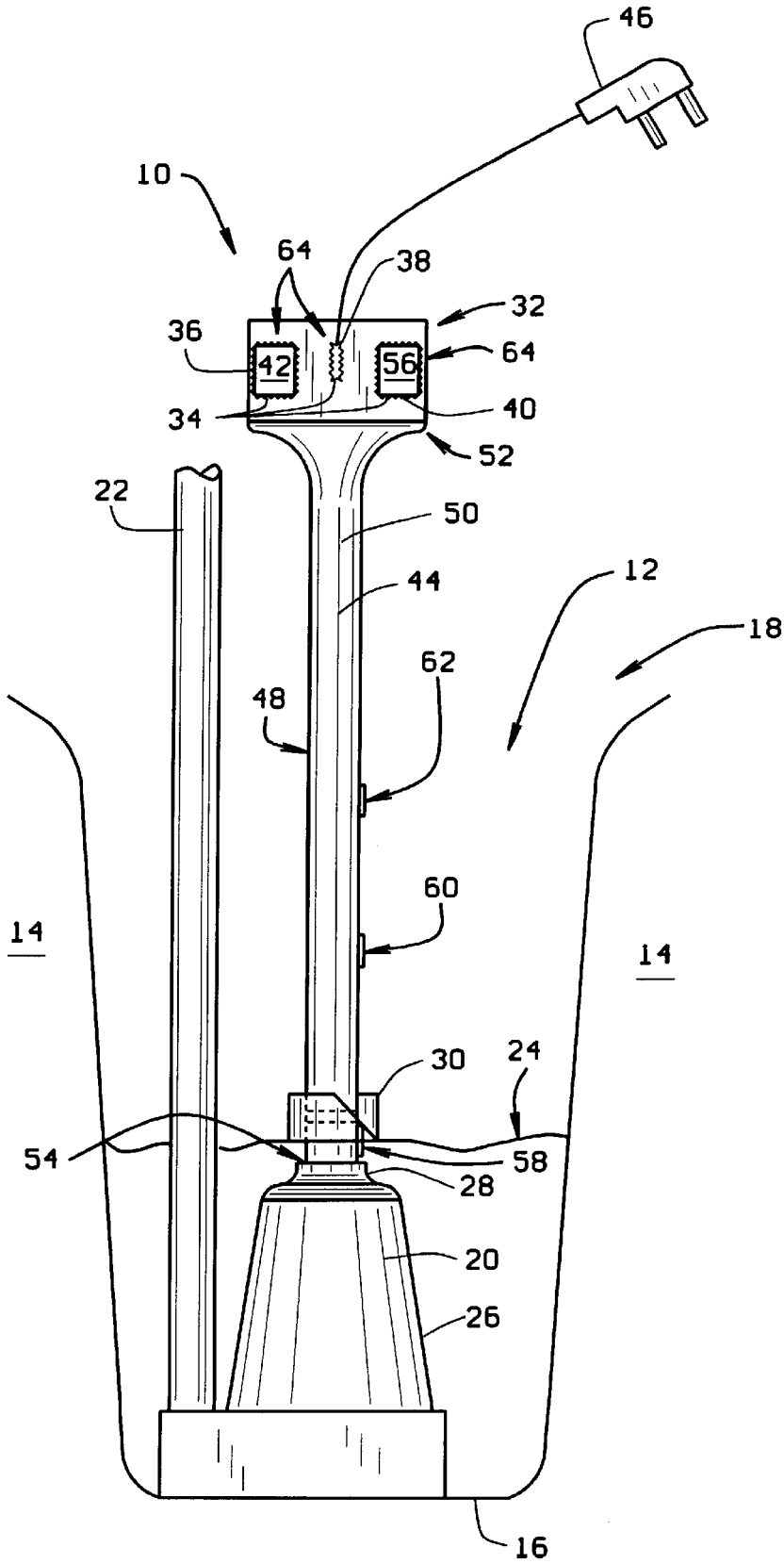
FIG. 1 is a schematic view of a sump including a first embodiment of a submersible sump pump.

FIG. 1 is a schematic illustration of a sump pump 10 for a sump 12. Sump 12 includes at least one side wall 14, a bottom 16, and a top opening 18. Sump pump 10 includes a motor 20 and an attached pump (not shown) connected to a discharge pipe 22. Sump pump 10 and discharge pipe 22 extend beyond drainage 24 accumulated in bottom 16 of sump 12. Motor 20 and the attached pump are located below drainage 24 and enclosed in a shell, or motor casing, 26 connected to a motor end shield 28. A sytrofoam float 30 is connected to sump pump 10 and moved by drainage 24 accumulated in sump 12.

Sump pump 10 further includes a pseudo pedestal, or mounting box, 32 including a plurality of openings 34. Openings 34 include a first opening 36, a second opening 38, and a third opening 40. An indicator 42 is mounted in first opening 36 in pseudo pedestal 32 and connected to motor 20, the attached pump, and a float switch 44. Indicator 42 includes a first light emitting device ("LED") (not shown) and a second LED (not shown) for display. The power source for the first LED and the second LED of indicator 42 is an alternating current or a switched alternating current utilized in sump pump 10. The first LED and the second LED include a resistor (not shown) which is in series connection with either a light emitting diode (not shown), a neon lamp (not shown), and/or a rectifier diode (not shown).

A power cord 46 is connected to sump pump 10 and float switch 44, and is mounted in second opening 38 in pseudo pedestal 32. Sump pump 10 includes a column, or conduit, 48 which connects pseudo pedestal 32 to motor 20 and the attached pump. Conduit 48 is substantially cylindrical and includes an opening 50 which extends therethrough from a first, or top, end 52 to a second, or bottom, end 54. Conduit 48 extends above motor 20 and the attached pump and supports pseudo pedestal 32, indicator 42, and power cord 46 above drainage 24.

Pseudo pedestal 32 is mounted on top end 52 of conduit 48 and further includes a high drainage alarm 56 mounted in third opening 40. In one embodiment, float switch 44 is mounted in column 48 and includes an OFF sensor 58, an ON sensor 60, and a high drainage sensor 62. High drainage alarm 56 is connected to power cord 46, float switch 44, and high drainage sensor 62. In one embodiment, high drainage alarm 56 includes a LED and an audible indicator.

OFF sensor 58, ON sensor 60, and high drainage sensor 62 are located between top end 52 and bottom end 54 of conduit 48 and directly correspond to a drainage level at which float switch 44 de-energizes motor 20, a drainage level at which float switch 44 energizes motor 20, and a drainage level at which float switch 44 sends a signal to high drainage alarm 56, respectively.

Wiring, or circuitry, from indicator 42, power cord 46, and high drainage alarm 56 extends through opening 50 in column 48 and is connected, through bottom end 54 which is mounted through motor end shield 28, to motor 20 and the attached pump.

In operation, drainage 24 is accumulated and collects in bottom 16 of sump 12. Once the drainage level rises above OFF sensor 58, styrofoam float 30 is moved along column 48. As the drainage level continues to rise in sump 12, styrofoam float 30 moves along column 48 toward ON sensor 60. When float 30 moves level with, and beyond ON sensor 60, float switch 44 energizes motor 20 and the attached pump. Float switch 44, motor 20 and the attached pump are powered by an alternating current which is directed through power cord 46. Motor 20 and the attached pump direct drainage 24 through discharge pipe 22 and out of sump 12 and the building.

Float 30 causes float switch 44 to transition from an open circuit which prevents current from flowing, to a first closed circuit which energizes motor 20 and the attached pump. Once the drainage level is lowered below OFF sensor 58 on column 48, float 30 causes float switch 44 to transition from the first closed circuit to the open circuit which prevents current from flowing and de-energizes motor 20 and the attached pump.

If a discharge rate of sump pump 10 is less than an accumulation rate of drainage 24, float 30 continues to move up column 48. When float 30 moves level with or beyond high drainage sensor 62, float switch 44 transitions to a second closed circuit which signals or energizes high drainage alarm 56. High drainage alarm 56 is powered either by a battery (not shown), a direct current circuit (not shown), or the alternating current supplied through power cord 46. High drainage alarm 56 includes an audible indicator which alerts a listener or observer, and a LED which also alerts the observer when either float switch 44 or motor 20 and the attached pump fails or where the accumulation rate of drainage 24 is greater than the discharge rate of sump pump 10.

The observer can determine the reason for an activation of high drainage alarm 56 by utilizing indicator 42. The first LED of indicator 42 is activated when motor 20 and the attached pump are operational and the second LED of indicator 42 is activated when float switch 44 is operational. Should the drainage level cause high water alarm 56 to be activated, and either the first LED or the second LED is not activated, then the observer can determine the cause of the accumulation.

At all times, power cord 46 is maintained above discharge 24 and is prevented from short circuiting due to discharge 24. First opening 36, second opening 38, and third opening 40 are formed in pseudo pedestal 32 and include a plurality of serrations (partially shown in FIG. 2), or small wall sections 64 to provide the necessary friction between the outer surface of indicator 42, power cord 46, and high drainage alarm 56 and maintain indicator 42, power cord 46, and high water alarm 56 within the body of pseudo pedestal 32.

Figure 2:
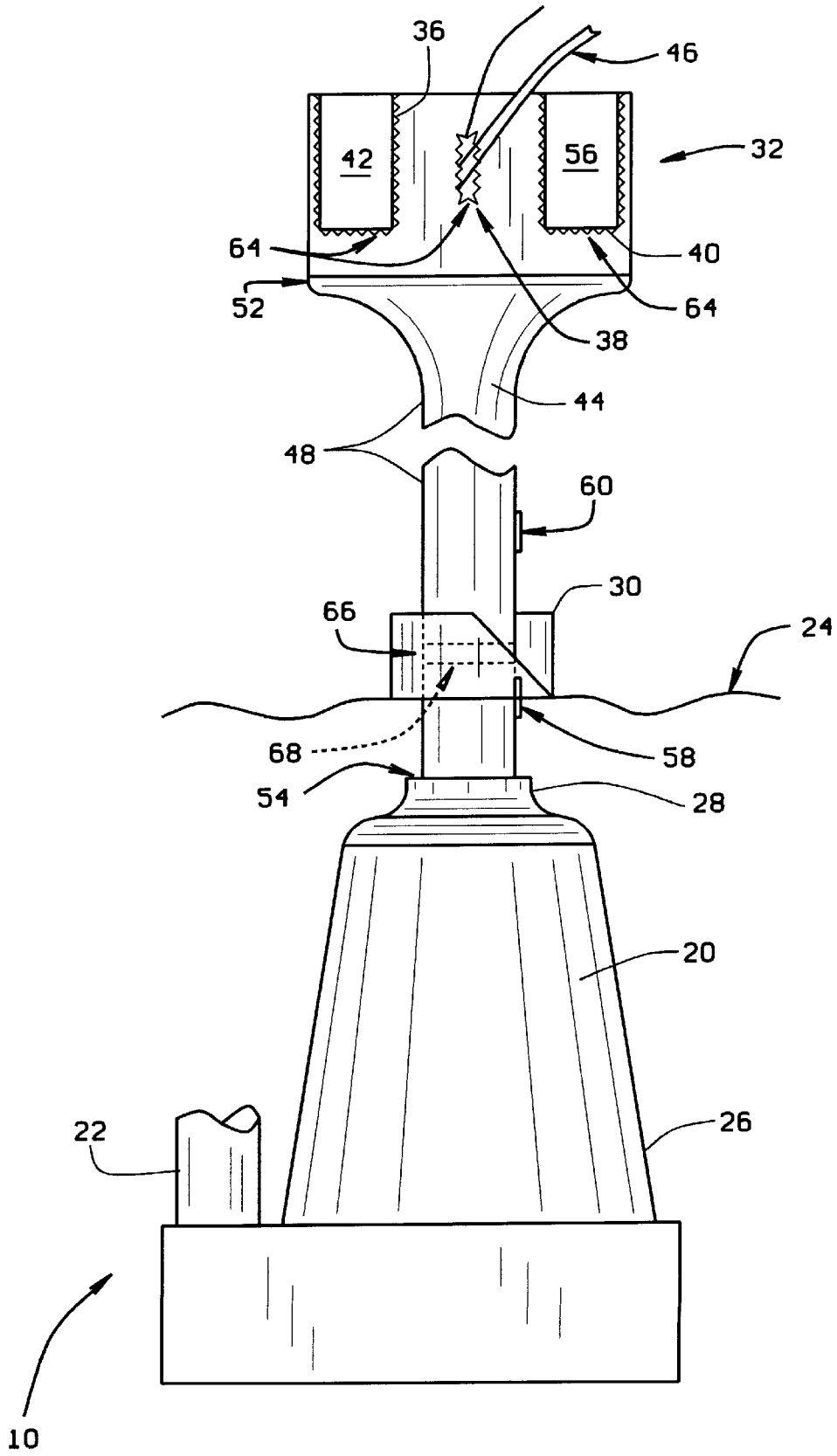
FIG. 2 is a cut-a-way view of the submersible sump pump.

FIG. 2 is a cut-away view of sump pump 10. First opening 36, second opening 38, and third opening 40 are located in pseudo pedestal 32 and are surrounded by serrations 64. Pseudo pedestal 32 is mounted on top end 52 of column 48 and supported above drainage 24. Styrofoam float 30 includes a float opening 66 therethrough and a steel ring 68 extending around float opening 66. Column 48 is positioned within and extends through float opening 66. Ring 68 is a complete ring formed from ferrous powder material. In an alternative embodiment, ring 68 is a split steel ring. Pseudo pedestal 32 is fabricated from a material that meets UL flammability requirement 94-5V for enclosure of electrical components, such as Noryl HS2000X, commercially available from Johnson Industrial Plastics, Lachine, Quebec. In an alternative embodiment, a polypropylene is utilized.

Drainage 24 accumulates in sump 12 (shown in FIG. 1) beyond OFF sensor 58 and lifts styrofoam float 30. The drainage level continues to rise in sump 12 until styrofoam float 30 moves level with and beyond ON sensor 60 which causes float switch 44 to transition to the first closed circuit and energize motor 20 and the attached pump. OFF sensor 58, ON sensor 60, and high water sensor 62 (shown in FIG. 1) are magnetic sensors which are activated by ring 68 traveling along column 48. In one embodiment, sensors 58, 60, and 62 (shown in FIG. 1) are magnetically coupled micro switches or sensors.

Second opening 38 is fabricated in pseudo pedestal 32 and surrounded by serrations 64. Power cord 46 is mounted in second opening 38 which provides the necessary friction and resistance that prevents power cord 46 from being disengaged with pseudo pedestal 32 and motor 20 and the attached pump.

Figure 3:
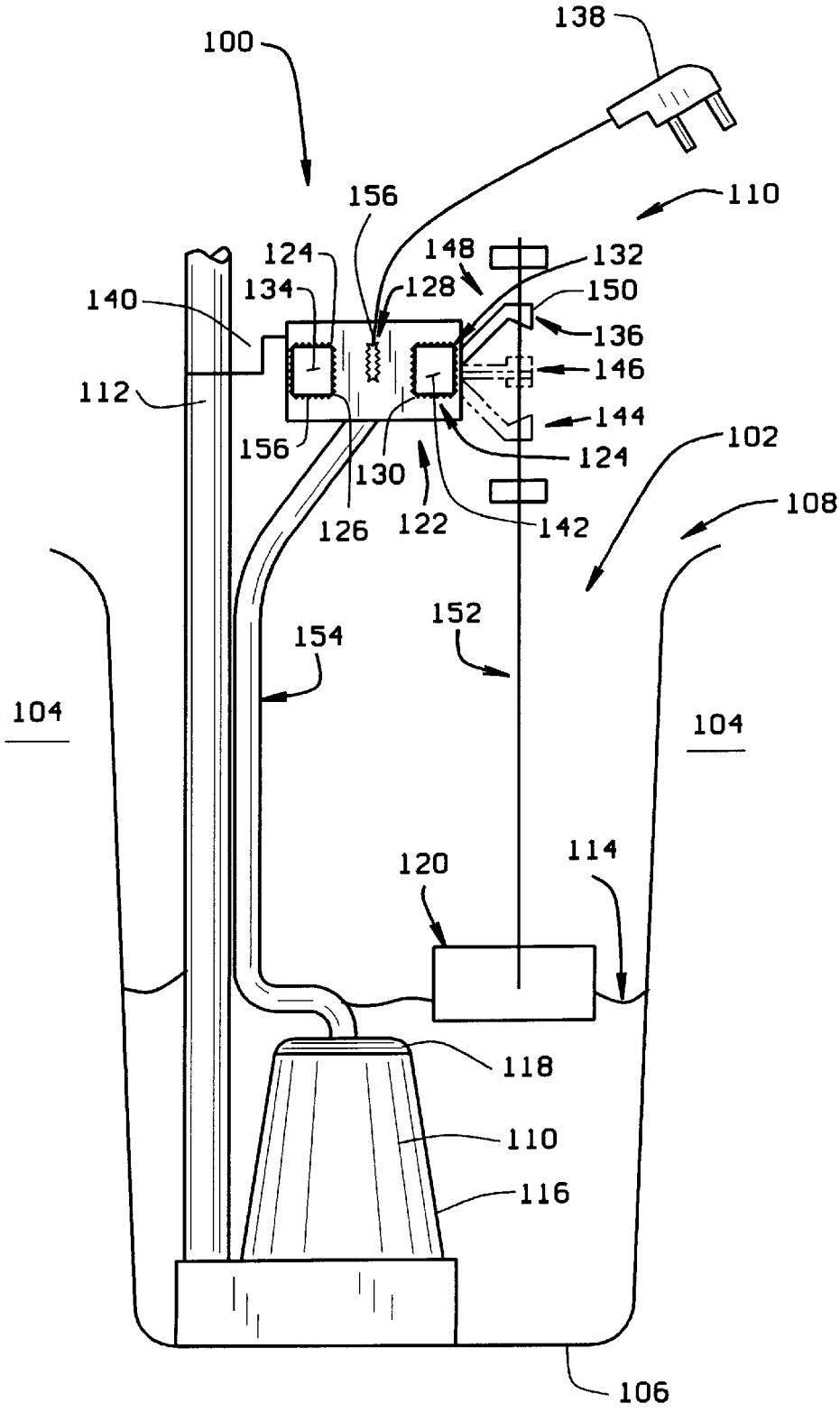
FIG. 3 is a schematic view of a sump including an alternative embodiment of a submersible sump pump.

FIG. 3 illustrates an alternate embodiment of a sump pump 100. A sump 25 102 includes at least one side wall 104, a bottom 106, and a top opening 108. Sump pump 100 includes a motor 110 and an attached pump (not shown) connected to a discharge pipe 112. Sump pump 100 and discharge pipe 112 extend beyond drainage 114 accumulated in bottom 106 of sump 102. Motor 110 and the attached pump are located below drainage 114 and enclosed in a shell, or motor casing 116. Motor casing 116 is connected to motor end shield 118. A sytrofoam float 120 is connected to sump pump 100 and elevated by drainage 114.

Sump pump 100 further includes a pseudo pedestal, or mounting box, 122 including a plurality of openings 124. Openings 124 include a first opening 126, a second opening 128, a third opening 130, and a fourth opening 132. An indicator 134 is mounted in first opening 126 in pseudo pedestal 122 and connected to motor 110 and a float switch 136. Indicator 134 includes a first LED (not shown) and a second LED (not shown) for display. The power source for the first LED and the second LED of indicator 134 is based on an alternating current and a switched alternating current utilized in sump pump 100. The first LED and the second LED include a resistor (not shown) which is in series connection with either a light emitting diode (not shown), a neon lamp (not shown), and/or a rectifier diode (not shown).

Sump pump 100 further includes a power cord 138 connected to sump pump 100 and float switch 136. Power cord 138 is mounted at least partially within second opening 128 in pseudo pedestal 122. Pseudo pedestal 122, including indicator 134, power cord 138, and float switch 136, are connected to discharge pipe 112 by a clasp 140.

Pedestal 122 further includes a high drainage alarm 142 mounted in third opening 130 and float switch 136 mounted in fourth opening 132. Float switch 136 includes an OFF position 144, an ON position 146, and a high drainage position 148. High drainage alarm 142 is connected to power cord 138 and float switch 136. High drainage alarm 142 includes a LED and an audible indicator.

OFF position 144, ON position 146, and high drainage position 148 are positions of a lever 150 which is connected to styrofoam float 120 by a float rod 152. Float switch 136 includes a quick make and quick break contact mechanism (not shown) and a non-teasable self cleaning and wiping contact (not shown) along with lever 150 which accepts a conventional float rod 152.

Wiring from indicator 134, power cord 138, high drainage alarm 142, and float switch 136 extends along discharge pipe 112 in a protective sheath 154, through end shield 118 and casing 116, to motor 110 and the attached pump. High drainage alarm 142 is powered either by a battery (not shown), a direct current circuit (not shown), or an alternating current supplied through power cord 138 to sump pump 100. High drainage alarm 142 includes an audible indicator (not shown) and a LED (not shown) which alerts an observer when either float switch 136 or motor 110 and the attached pump fails, or when drainage 114 accumulates faster than it is discharged.

In operation, drainage 114 elevates styrofoam float 120 which moves float rod 152 and lever 150 beyond OFF position 144. The drainage level continues to 15 rise in sump 102 until it moves lever 150 to or beyond ON position 146 which causes float switch 136 to transition from an open circuit which prevents current from flowing to a first closed circuit which energizes motor 110 and the attached pump. Float switch 136 and motor 110 are powered by a switched alternating current which is directed through float switch 136 from an alternating current supplied through power cord 138. The pump directs drainage 114 into and through discharge pipe 112 and out of sump 102.

Should a discharge rate of sump pump 100 be less than an accumulation rate of drainage 114, styrofoam float 120 continues to move lever 150 up by moving float rod 152 up as well. Once lever 150 moves to high drainage position 148, float switch 136 transitions from the first closed circuit to a second closed circuit which activates high drainage alarm 142.

First LED of indicator 134 is activated when motor 110 is operational and second LED is activated when float switch 136 is operational. Should the drainage level rise sufficiently to cause high water alarm 142 to be activated, and either first LED or second LED is not activated the observer can determine the cause of the accumulation.

Power cord 138 is maintained above discharge 114 and prevented from short circuiting due to exposure to discharge 114. Pseudo pedestal 122 includes a plurality of serrations or small wall sections, 156 surrounding openings 126, 128, 130, and 140. Serrations 156 provide the necessary friction between the outer surface of indicator 134, power cord 138, float switch 136, high drainage alarm 142 and pseudo pedestal 122 to maintain indicator 134, power cord 138, float switch 136, and high drainage alarm 142 within pseudo pedestal 122.

Figure 4:
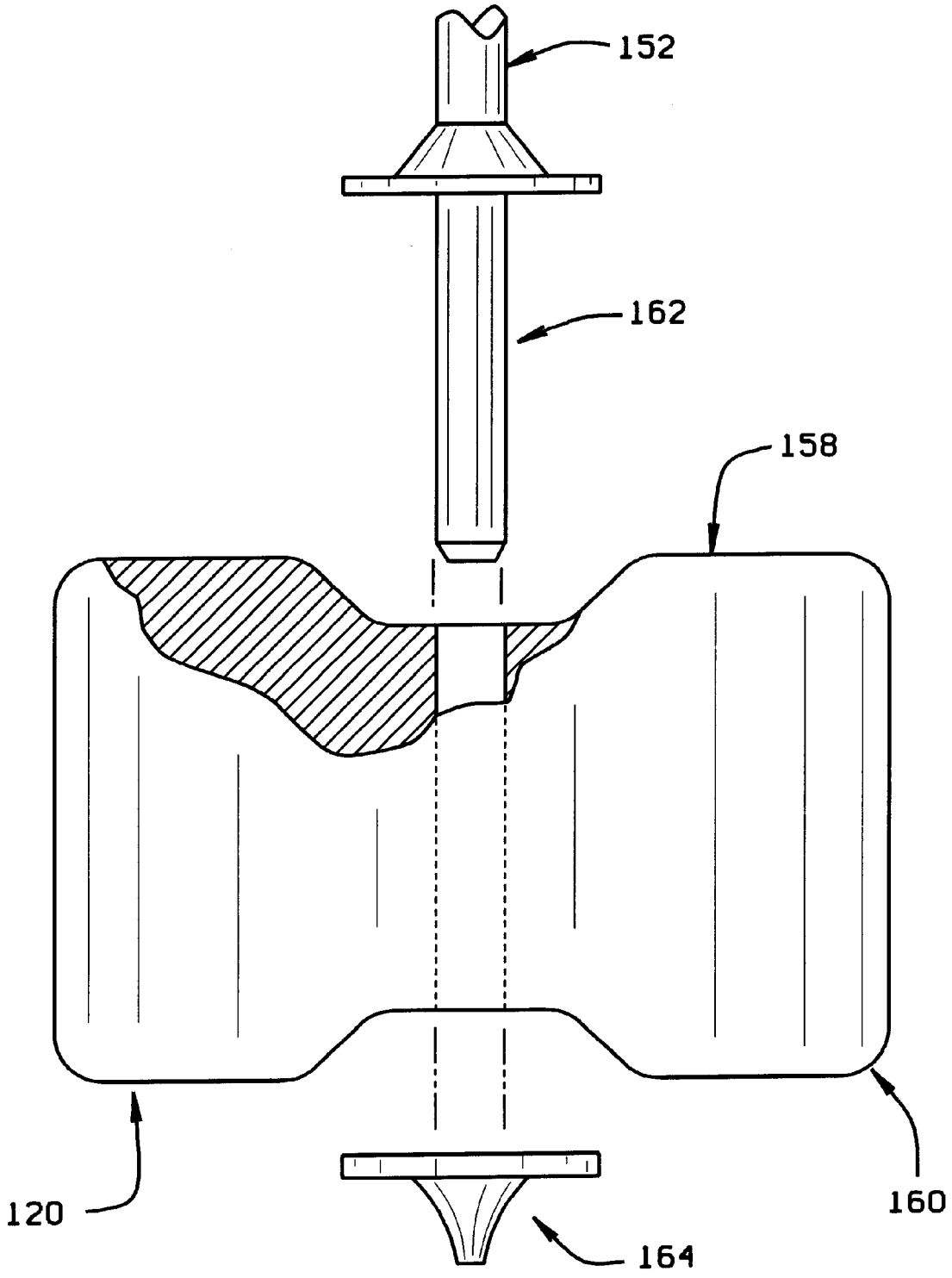
FIG. 4 is an enlarged view of a styrofoam float utilized in the submersible sump pump shown in FIG. 3.

FIG. 4 illustrates styrofoam float 120 including a top portion 158 and a bottom portion 160. Float rod 152 includes an insert 162 and a cap 164 which extend through and are adjacent to top portion 158 and bottom portion 160, respectively, of float 120.

Styrofoam float 120 is connected to float rod 152 by insertion of insert 162 through top portion 158 of styrofoam float 120. Insert 162 extends from top portion 158 through bottom portion 160 of float 120. Once insert 162 extends fully through float 120, cap 164 is connected to insert 162 on bottom portion 160 of float 120 which secures float 120 to float rod 152.

Figure 5:
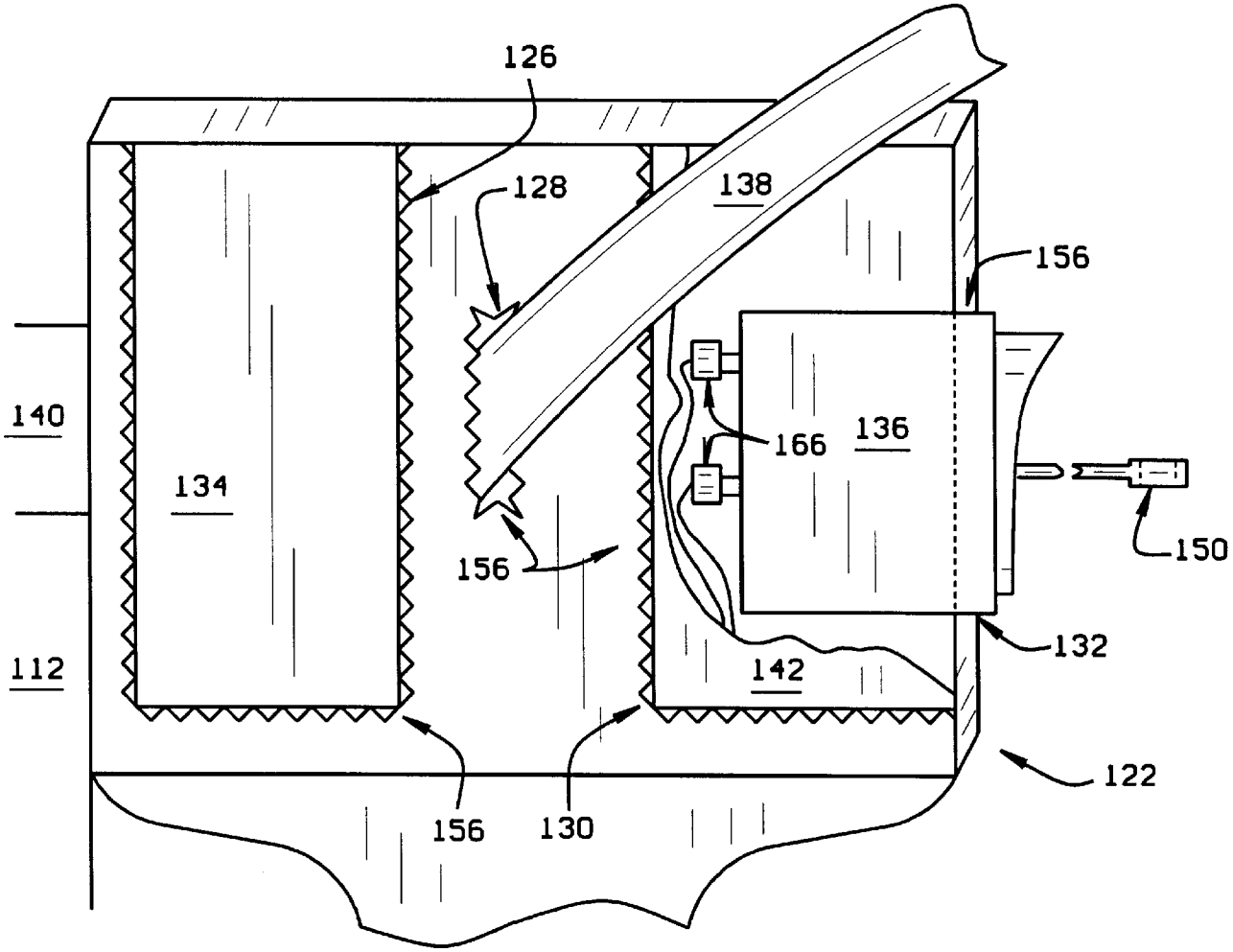
FIG. 5 is an enlarged view of a pseudo pedestal utilized in the submersible sump pump shown in FIG. 3.

FIG. 5 illustrates float switch 136 connected to pseudo pedestal 122. Float switch 136 includes a plurality of leads 166 which extend from float switch 136 through pseudo pedestal 122 and sheath 154 (shown in FIG. 3) to motor 110 (shown in FIG. 3) and the attached pump (not shown).

A cost effective sump pump 100, in comparison to comparably rated pedestal sump pumps, is provided which prevents damage caused by accumulated drainage without the added complexity of typical sump pumps, such as the breakage or locking which occurs with typical plastic floats. Also, problems with motor failure due to the exposure and short circuiting of power cord 138 are eliminated by sump pump 100.

While the invention has been described in terms of various specific embodiments, those skilled in the art will recognize that the invention can be practiced with modifications within the spirit and scope of the claims.

What is claimed is:

1. A pump system for a sump, said pump system comprising:

a motor including an end-shield;

a primary pump connected to said motor;

a shell enclosing said motor and said primary pump, said shell connected to said end-shield;

a discharge pipe in flow communication with said motor and said primary pump, said discharge pipe extending from said shell through a top of the sump;

a pseudo pedestal in communication with said motor, said pseudo pedestal connected to said discharge pipe; and a styrofoam float in communication with said motor and said primary pump, said float configured to connect to said pseudo pedestal.

2. A pump system in accordance with claim 1 further comprising a high drainage alarm connected to said styrofoam float.

3. A pump system in accordance with claim 1 further comprising a float switch connected to said styrofoam float.

4. A pump system in accordance with claim 3 wherein said float switch comprises a lever and a float rod, said lever connected to said float rod which is connected to said styrofoam float, said lever configured to move from a first selected position to a second selected position and to a third selected position.

5. A pump system in accordance with claim 3 wherein said pseudo pedestal comprises a plurality of openings.

6. A pump system in accordance with claim 5 further comprising:

an indicator connected to said motor and said float switch, said indicator mounted in one of said openings in said pseudo pedestal; and a power cord connected to said motor, said power cord further connected to said indicator and said float switch, said power cord mounted in one of said openings in said pseudo pedestal.

7. A pump system in accordance with claim 5 further comprising a channel comprising a top end, a bottom end, and an opening extending through said channel from said top end to said bottom end, said pseudo pedestal connected to said top end of said channel.

8. A pump system in accordance with claim 7 wherein said float switch comprises a first sensor, a second sensor, and a third sensor.

9. A sump pump comprising:

a motor;

a primary pump connected to said motor;

a motor casing, said motor and said primary pump positioned within said casing;

a float switch in communication with said motor, said float switch comprising an OFF sensor, an ON sensor, and a high drainage sensor;

a styrofoam float in communication with said motor and said primary pump;

a column comprising a top end, a bottom end, and an opening extending through said column from said top end to said bottom end, said float configured to move concentrically around said column; and a power cord connected to said motor and to said float switch.

10. A sump pump in accordance with claim 9 further comprising a high drainage alarm connected to said float switch.

11. A sump pump in accordance with claim 10 further comprising a pseudo pedestal connected to said high drainage alarm, said pseudo pedestal comprising a first opening, a second opening, and a third opening, said high drainage alarm mounted in said third opening.

12. A sump pump in accordance with claim 11 wherein said pseudo pedestal comprises a plurality of serrations extending around said first opening, said second opening, and said third opening.

13. A sump pump in accordance with claim 12 wherein said column connected to said pseudo pedestal, said pseudo pedestal mounted on said top end of said column.

14. A sump pump in accordance with claim 13 wherein said float switch is mounted in said column, said OFF sensor, said ON sensor, and said high drainage sensor extending through said column opening to an exterior surface of said column.

15. A sump pump in accordance with claim 14 further comprising an indicator connected to said motor and said float switch, said indicator mounted in said pseudo pedestal first opening.

16. A sump pump in accordance with claim 15 wherein said styrofoam float connected to said float switch.

17. A sump pump in accordance with claim 16 wherein said float comprises an opening therethrough and a steel ring extending around said opening, said column positioned within said opening and said steel ring.

18. A sump pump comprising:

a motor;

a primary pump connected to said motor;

a motor casing, said primary pump and said motor positioned within said casing;

a mounting box comprising a first opening, said mounting box in communication with said motor;

a conduit connecting said motor and said primary pump to said mounting box, said conduit comprising a conduit opening, a first end, and a second end, said conduit opening extending from said first end to said second end, said second end of said conduit in communication with said motor;

a styrofoam float comprising a float opening extending therethrough, said styrofoam float in communication with said motor and said primary pump and said float configured to move concentrically around said conduit; and an indicator mounted within said first opening of said mounting box, said indicator connected to said motor and configured to detect operation of said motor.

19. A sump pump in accordance with claim 18 wherein said mounting box further comprises a second opening, said sump pump further comprising a power cord mounted within said second opening, said power cord connected to said motor and said float switch, said power cord extending from said mounting box to said motor through said conduit opening.

20. A sump pump in accordance with claim 18 wherein said mounting box further comprises a third opening, said sump pump further comprising a high drainage alarm mounted within said third opening, said high drainage alarm in communication with said motor and said conduit.

21. A sump pump in accordance with claim 20 wherein said high drainage alarm is powered by a direct current.

22. A sump pump in accordance with claim 20 wherein said high drainage alarm is powered by an alternating current.

23. A sump pump in accordance with claim 20 wherein said high drainage alarm comprises a light emitting device.

24. A sump pump in accordance with claim 23 wherein said high drainage alarm further comprises an audible indicator.

25. A sump pump in accordance with claim 24 wherein said styrofoam float further comprises a steel ring extending around said conduit.

26. A sump pump in accordance with claim 25 further comprising a float switch mounted in said conduit, said float switch comprising an OFF sensor, an ON sensor, and a high drainage sensor, said OFF sensor, said ON sensor, and said high drainage sensor located between said first end and said second end of said conduit.

27. A sump pump in accordance with claim 26 wherein said OFF sensor, said ON sensor, and said high drainage sensor are magnetic sensors.

28. A sump pump in accordance with claim 20 wherein said indicator is further connected to said float switch, said indicator further configured to detect operation of said float switch.

29. A sump pump in accordance with claim 28 wherein said indicator comprises a first light emitting device and a second light emitting device, said first light emitting device configured to activate when said motor is powered, said second light emitting device configured to activate when said float switch is activated.

30. A method for assembling a sump pump, the sump pump including a motor connected to a primary pump, the motor and the pump enclosed in a motor casing, a discharge pipe extending from the motor casing in flow communication with the motor and the primary pump, a mounting box in communication with the motor, an indicator, a styrofoam float in communication with the motor and the primary pump, the sump pump further including a float switch including an OFF sensor, an ON sensor, and a high drainage sensor, said method comprising the steps of:

fabricating the indicator;

coupling the mounting box to the motor such that the mounting box is connected to the discharge pipe;

connecting the indicator to the motor and the float switch such that the float switch is coupled to the mounting box; and utilizing the indicator in the sump pump.

31. A method in accordance with claim 30 wherein said step of fabricating a light emitting device comprises the steps of:

assembling a light emitting device;

providing a power source; and mounting the assembled light emitting device across the power source.

32. A method in accordance with claim 30 wherein said step of fabricating an indicator comprises the step of fabricating a light emitting device.

33. A method in accordance with claim 32 wherein said step of providing a power source comprises the step of providing an alternating current power.

34. A method in accordance with claim 32 wherein said step of providing a power source comprises the step of providing a switched alternating current power.

35. A method in accordance with claim 32 wherein said step of assembling a light emitting device comprises the step of assembling a resistor in series connection with a light emitting diode.

36. A method in accordance with claim 32 wherein said step of assembling a light emitting device comprises the step of assembling a resistor in series connection with a neon lamp.

37. A method in accordance with claim 32 wherein said step of assembling a light emitting device comprises the step of assembling a resistor in series connection with a light emitting diode and a rectifier diode.

38. A method in accordance with claim 32 wherein said step of assembling a light emitting device comprises the step of assembling a resistor in series connection with a neon lamp and a rectifier diode.

39. A method in accordance with claim 32 wherein said step of assembling a light emitting device comprises the step of assembling a resistor in series connection with an incandesent lamp and a rectifier diode.

* * * * *